US005707511A

United States Patent [19]

Markley et al.

[11] Patent Number: 5,707,511

[45] Date of Patent: Jan. 13, 1998

[54] CYCLIC PROCESS FOR HYDROTREATING PETROLEUM FEEDSTOCKS

[75] Inventors: Gerald E. Markley, Baton Rouge, La.; George C. Hadjiloizou, Succasunna, N.J.

[73] Assignee: Exxon Research and Engineering Company, Florham Park, N.J.

[21] Appl. No.: 362,073

[22] Filed: Dec. 22, 1994

[51] Int. Cl.[6] ..... C10G 45/02

[52] U.S. Cl. ..... 208/210; 208/12; 208/78; 208/218

[58] Field of Search ..... 208/78, 220, 210, 208/12, 218

[56] References Cited

U.S. PATENT DOCUMENTS

| | | | |
|---|---|---|---|
| 1,977,717 | 10/1934 | Davis et al. | 208/220 |
| 3,763,033 | 10/1973 | Stauffer et al. | 208/78 |
| 3,941,680 | 3/1976 | Byson et al. | 208/78 |
| 4,846,959 | 7/1989 | Kenedy et al. | 208/78 |
| 4,956,509 | 9/1990 | Harnadi | 208/78 |
| 4,966,681 | 10/1990 | Herbst et al. | 208/78 |
| 4,990,242 | 2/1991 | Lowie et al. | 208/78 |
| 5,002,915 | 3/1991 | Harandi et al. | 208/78 |

*Primary Examiner*—Helane Myers

*Attorney, Agent, or Firm*—Henry E. Naylor

[57] ABSTRACT

A process for simultaneously removing heteroatoms, such as sulfur, from a virgin distillate stream and a light catalytic cyclic stream in two reaction zones in a hydrotreating process unit. One reaction zone will be a low temperature reaction zone and the other will be the high temperature zone. In the low temperature reaction zone, the cracked stream is reacted with a hydrotreating catalyst at a predetermined temperature and in high temperature reaction zone, the virgin distillate stream is reacted with a catalyst which is less reactive than that of the first reaction zone. When catalyst in the high reaction zone is replaced with fresh catalyst the temperature is lowered so that it now becomes the low temperature zone in which the cracked stream is redirected. Correspondingly, the virgin stream is redirected to the other reaction zone whose temperature is now raised and which becomes the high temperature zone and which now contains a catalyst less active than the low temperature reaction zone which now contains the fresher more active catalyst. This cyclic operation is repeated each time fresh catalyst is substituted for spent catalyst.

5 Claims, 1 Drawing Sheet

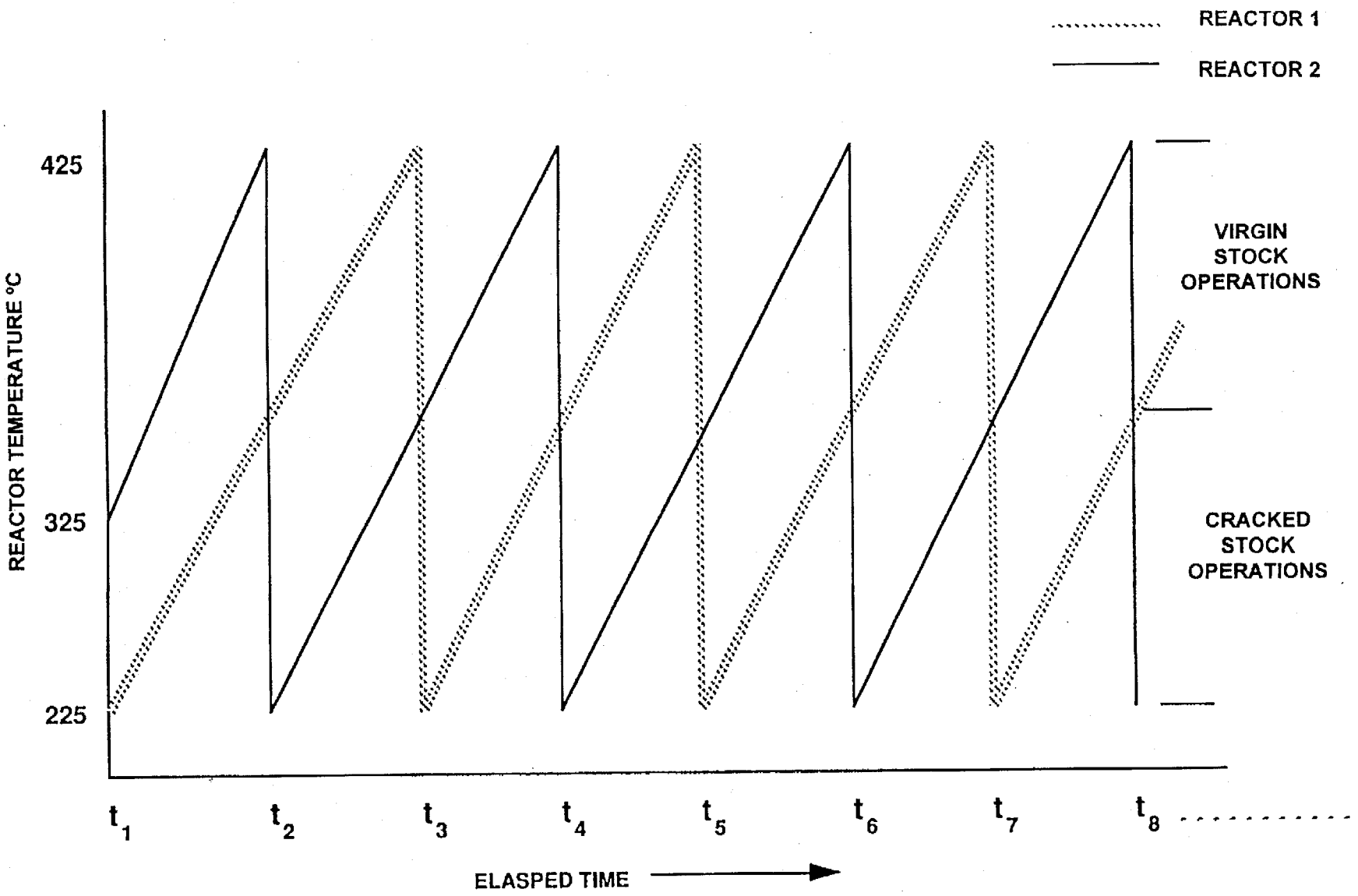
REACTOR 1
REACTOR 2
VIRGIN STOCK OPERATIONS
CRACKED STOCK OPERATIONS
425
325
225
REACTOR TEMPERATURE °C
$t_1$
$t_2$
$t_3$
$t_4$
$t_5$
$t_6$
$t_7$
$t_8$
ELASPED TIME

CYCLIC PROCESS FOR HYDROTREATING PETROLEUM FEEDSTOCKS

FIELD OF THE INVENTION

The present invention relates to a process for removing heteroatoms, such as sulfur, from a virgin distillate stream and a light catalytic cyclic stream in two reaction zones simultaneously.

BACKGROUND OF THE INVENTION

It is important to remove heteroatoms, such as sulfur, from petroleum refinery streams. Not only must sulfur be removed to meet environmental regulations, but it must be removed because it is a poison for various downstream catalysts. Consequently, the petroleum refinery industry, as well as catalyst manufacturers, have done much work over the years to develop improved catalysts and processes for removing such heteroatoms.

Sulfur removal from refinery streams is typically accomplished by passing the sulfur-containing stream to a process unit wherein it is contacted, at elevated temperatures in the presence of hydrogen, with a suitable hydrotreating catalyst. Such a process is typically referred to as hydrotreating process and where the heteroatom to be removed is sulfur, the process is more specifically referred to as hydrodesulfurization. Conventional hydrotreating catalysts are comprised of at least one Group VIII metal, especially Co or Ni, and a Group VI metal, particularly molybdenum, on an inorganic support, such as alumina.

Many commercial hydrotreating process units found in a complex refinery are comprised of two reactors. A typical feedstream to hydrotreating units is a mixture of virgin distillate and a cracked stream, such as a product stream from fluid catalytic cracking. Both reactors will typically contain the same catalyst and over the course of time, the catalyst steadily deactivates and the temperature in the reactors must be steadily increased to compensate for this deactivation. Unfortunately, the determining factor for catalyst change-out is not necessarily the ultimate activity of the catalyst, but the color intensity of the product stream. That is, as the temperature is raised, the aromatics in the cracked stream are converted to multi-ring aromatics, which increases the color intensity of the stream to such a point that is exceeds a predetermined specification or target. At this point, the hydrotreating unit is shut-down and the catalyst in both reactors is replaced with fresh catalyst. The disadvantage of such a procedure is that the unacceptable color intensity is reached at relatively low temperatures, for example at approximately 340° C. for many cracked feed blends.

Thus, there is a need in the art for hydrotreating processes which are capable of extending the cycle length of a multistage hydrotreating process unit into which is fed a mixture of virgin and cracked feedstock. The present invention describes a hydrotreating process by which acceptable color of the product stream can be maintained, cycle lengths extended, and downtime and catalyst costs reduced.

The present invention allows a refiner to synergistically use two hydrotreating units. That is, two hydrotreating units, one acting as a lower temperature unit for processing cracked feed and the other a higher temperature unit for processing a virgin distillate feed, can be operated significantly more efficiently together than if operated alone by conventional methods.

SUMMARY OF THE INVENTION

In accordance with the present invention, there is provided a process for removing heteroatoms from a virgin distillate feedstock and a light catalytic cycle oil in two reaction zones simultaneously, wherein one reaction zone is a lower temperature reaction zone and the other is a higher temperature reaction zone, and wherein said lower temperature reaction zone contains a hydrotreating catalyst which is more active than that of said higher temperature reaction zone, which process comprises:

(a) feeding a cracked distillate feedstock into said lower temperature reaction zone which is operated at a temperature from about 225° to about 340° C. and contains a catalyst that is more active catalyst than the catalyst in the higher temperature reaction zone, which catalyst is comprised of at least one Group VI metal and at least one Group VIII metal on a inorganic support;

(b) feeding the virgin distillate feedstock into said higher temperature reaction zone containing a catalyst which is less active than that of said lower temperature reaction zone, which higher temperature reaction zone is operated at a temperature from about 325° C. to about 425° C., but at a temperature at least 25° C. in excess of the temperature of said lower temperature zone, and wherein the catalyst is comprised of at least one Group VI metal and at least one Group VIII metal on an inorganic support;

(c) maintaining an effective catalyst activity in each reaction zone by raising the temperature of each reaction zone to compensate for catalyst deactivation until a temperature is reached in either reaction zone wherein the color of the product stream of either reaction zone is outside of a predetermined target color range;

(d) removing the deactivated catalyst from the higher temperature reaction zone and replacing it with fresh catalyst;

(e) lowering the temperature of said higher temperature zone to a temperature at least about 25° C. lower than said lower temperature zone;

(f) redirecting the cracked feedstock to the now lower temperature zone which now contains the more active catalyst and which is now operated at a temperature from about 225° C. to about 340° C.; and (g) redirecting the virgin distillate feedstock to the now higher temperature zone which now contains the less active catalyst and which is now operated at a temperature from about 325° C. to about 425° C., but at a temperature at least 25° C. in excess of that of the now lower temperature reaction zone; and (h) repeating the above steps every time the color of the product stream of either reaction zones exceeds a predetermined color range for an indefinite number of cycles.

In a preferred embodiment of the present invention, the catalyst in each of the reaction zones is comprised of molybdenum and Ni and/or Co on alumina.

BRIEF DESCRIPTION OF THE FIGURE

The sole FIGURE hereof is a hypothetical representation of the practice of the present hydrotreating process wherein two different feedstocks, a virgin feedstock and a cracked feedstock, are simultaneously hydrotreated in two hydrotreating zones—a high temperature zone and a low temperature zone. The temperature, in degrees celsius, is plotted against time shown in intervals of $t_n$, where n is a whole number and represents those points in time when catalyst replacement is necessary. The catalyst replacement will be necessary when the color of one or both of the product streams is outside of a predetermined color target.

DETAILED DESCRIPTION OF THE INVENTION

The instant invention is employed where it is desirable to simultaneously hydrotreat a virgin feedstock and a cracked feedstock. The term "virgin" feedstock, or stream, as used herein, means that the stream is composed of petroleum compounds which have been obtained from crude oil without having gone though any substantial chemical change in previous processing. Such streams typically come from a crude distillation process which merely fractionates the crude according to predetermined boiling point cuts and does not catalytically crack the feed. The aromatics content of such feedstocks are relatively low and typically range from about 0 to 50 wt. %, more preferably from about 10 to 40 wt. %. Little, if any, of the aromatics are multi-ring aromatics. Preferred virgin streams are those in the distillate boiling range. That is, those streams boiling from about 140° to 360° C. and which are often referred to as middle distillates, or light gas oil streams. They include fuels referred to as diesel fuels, jet fuels, and heating fuels.

The term "cracked feedstock" or "cracked stream", as used herein, means a stream that is at least partly derived from a conversion process in which at least some of the compounds of the stream have undergone a chemical change, usually as a result of high temperature catalytic reactions. Preferred cracked streams are those that boil in the distillate range, that is, from about 140° C. to about 360° C. Cracked feedstocks typically contain relatively high levels of aromatics, particularly multi-ring aromatics, which form undesirable color bodies during hydrotreating processing, especially at the higher temperatures needed to compensate for catalyst deactivation. Such streams are typically product streams from fluid catalytic cracking and are often referred to as light cat cycle oils. Total aromatics levels in catalytic cracked feedstocks typically range from about 50 to 100%, preferably from about 60 to 90%, by volume.

Distillate boiling range streams typically contain relatively high sulfur levels. The sulfur must be lowered for various reasons, such as to meet environmental regulations and/or to prevent poisoning of downstream catalysts. The sulfur is usually removed by feeding the stream to a hydrotreating process unit which contains one or more reactors, or reaction zones. Mixed virgin/cracked petroleum streams are conventionally hydrotreated in a such a process unit, often in a process unit containing two reactors. The mixed feed is fed to a first reactor and the product of said first reactor is fed to a second reactor. Both reactors are typically operated at the same conditions and both usually contain substantially the same catalyst having approximately the same activity. During the course of time, the temperature of operation must be increased to compensate for the steadily decreasing activity of the catalysts. The temperature limit of the process is frequently determined by a predetermined product color target. That is, when the color of the product stream exceeds this predetermined target, the process is stopped and the catalyst in both reaction zones is changed-out for fresh catalyst. The discarded catalyst is still active for sulfur removal, but only at temperatures at which undesirable color bodies are produced. As previously mentioned, it is believed that these undesirable color bodies result from the high aromatics content of the cracked portion of the feed. That is, as the temperature is increased, aromatics in the cracked feed are converted to undesirable color bodies, such as multi-ring aromatic compounds.

The instant cyclic process is suitable for use on any hydrotreating process which employs multiple reactors. It can also be employed by using one independent hydrotreating process unit as one reaction zone and another independent hydrotreating process unit as another reaction zone. That is, the reaction zones can be either different reactors in the same hydrotreating process unit, or they can be independent hydrotreating process units. The practice of the present process allows for a longer cycle time. That is, it allows for higher temperatures with a portion of the feed, thus prolonging the time before catalyst change-out is needed. The practice of the present invention also allows for a continuing operation of the process unit, even during catalyst change-out of one of the reaction zones.

Reference is made to FIG. 1 which is a hypothetical temperature vs. time plot wherein two reaction zones are employed and are represented by two individual reactors. Reactor 1, into which a cracked feedstock is initially fed, is operated at an initial operating temperature $t_1$ of 225° C. and contains an active fresh catalyst charge. Reactor 2, into which a virgin feedstock is initially fed in the FIGURE, is operated at an initial temperature $t_1$ of about 325° C. and contains a less active hydrotreating catalyst. Although FIG. 1 shows a 100° C. temperature difference between the reactors, it will be understood that the present invention can be practiced by maintaining a temperature difference between reactors of at least about 25° C., preferably at least about 50° C. The catalyst in each reaction zone is a conventional hydrodesulfurization catalyst which is typically comprised of a Group VI metal with one or more Group VIII metals as promoters, on a refractory support. It is preferred that the Group VI metal be molybdenum or tungsten, more preferably molybdenum. Cobalt is the preferred Group VIII metal with alumina being the preferred support. The Group VIII metal is present in an amount ranging from about 2 to 20 wt. %, preferably from about 4 to 12 wt. %. The Group VI metal is present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weight 100 g., then 20 wt. % Group VIII metal would mean that 20 g. of Group VIII metal was on the support. Any suitable refractory support can be used. Such supports are typically inorganic oxides, such as alumina, silica, silica-alumina, titania, and the like. The hydrotreating is conducted at conventional hydrotreating pressures from about 50 to 900 psig; preferably from about 150 to 800 psig; hourly space velocities from about 0.2 to 6 V/V/Hr; and a hydrogen gas rate of about 200 to 5000 SCF/B; where SCF/B means standard cubic feet per barrel, and V/V/Hr means volume of fuel per volume of the reactor vessel per hour.

Returning now to the FIGURE, the temperatures of both reactors are increased during operation to compensate for the deactivation of catalyst in each reactor. While the FIGURE shows the rate of temperature increase to be equal for each of the reactors, it is to be understood that this is for illustrative purposes only and that in a commercial operation it is likely that the rate of temperature increase will most likely be different for each of the reactors. The FIGURE also shows the maximum temperature of the higher temperature reactor being about 425° C. It is preferred that the temperature not exceed this limit. At some point during operation, the color or either the product stream from reactor 1 or reactor 2, or the color of a mixture of these two product streams will be outside of a predetermined target color. The FIGURE shows this point being at 425° C. for the higher temperature reactor. At that point in the operation, at time $t_2$, the catalyst of reactor 2 is replaced with fresh catalyst, the operating temperature dropped to 225° C., and the cracked feedstock is introduced instead of virgin feedstock. The virgin feedstock is then fed into reactor 1 and operations are continued. Reactor 2 has now become the lower temperature reactor containing the more active catalyst and reactor 1 has become the higher temperature reactor containing the less active catalyst. During continued operation the temperatures are again raised in each reactor to compensate for catalyst deactivation until the color of one, both, or a mixture of the product streams is outside of the predetermined target. This is represented by $t_3$ and is the point in time wherein catalyst is again changed-out in the higher temperature reactor, the temperature lowered in the higher temperature reactor to a temperature at least about 25° C. lower than what was the lower temperature reactor, and the feedstocks switched from one reactor to the other. This cycle is continued for an indefinite period of time. That is, for a time period for which the process units are shut-down for any business or technical reason.

As previously stated, the end-of-run temperature limit in the reactor operating at the higher temperature, for purposes of this invention, is reached when the color of the product stream from either reaction zone exceeds a predetermined color target. Virgin distillates are less prone to color-body formation and are therefore fed to the said high temperature reactor. That is, as the temperature is increased, the aromatics in both feedstocks are converted to more harmful color bodies which causes the product stream to become more intense in color and to fall outside of a predetermined color target. For example, the distillate color target is typically about 0 to 1.5, based on the ASTM D-1500 color test. In the event that the higher temperature reaction zone exceeds the color target first, the cracked feed can continue to be fed to the lower temperature reaction zone, which still remains in operation during catalyst change-out of the higher temperature reaction zone. In the event that the lower temperature reaction zone exceeds the color target, virgin feedstock is transferred to that reaction zone while the higher temperature reaction zone is re-charged. During operation, the temperature range of the lower temperature reaction zone, which is typically initially at about 225° C. and will climb to roughly 340° C. during a cycle because as the catalyst deactivates the temperature is raised to maintain catalyst activity. If the temperature in the reaction zone to which the cracked feed is fed exceeds about 340° C., an undesirable amount of intense color bodies will typically be formed, thus causing the product stream to exceed the predetermined color target. The temperature range of the higher temperature reactor is from about 325° C. to about 425° C.

What is claimed is:

1. A process for removing sulfur from a virgin distillate feedstock and a light catalytic cycle oil in two reaction zones, wherein one reaction zone is the lower temperature reaction zone and the other is the higher temperature reaction zone, and wherein said lower temperature reaction zone contains a hydrotreating catalyst which is more active than that of said higher temperature reaction zone, which process comprises:

(a) feeding cracked distillate feedstock into said lower temperature reaction zone which is operated at a temperatures from about 225° to about 340° C. and contains the more active catalyst, which catalyst is comprised of at least one Group VI metal and at least one Group VIII metal on a inorganic support;

(b) feeding the virgin distillate feedstock into said higher temperature reaction zone containing the less active catalyst, which higher temperature reaction zone is operated at a temperature from about 325° C. to about 425° C., but at a temperature at least 25° C. in excess of the temperature of said lower temperature zone;

(c) raising the temperature of each reaction zone to compensate for catalyst deactivation until a temperature is reached wherein the color of either product stream or the combined product stream, is outside of a predetermined target color range;

(d) removing the deactivated catalyst from the higher temperature reaction zone and replacing it with fresh catalyst;

(e) lowering the temperature of said higher temperature zone to a temperature at least about 25° C. lower than said lower temperature zone;

(f) redirecting the cracked feedstock to the now lower temperature zone which now contains the more active catalyst and which is now operated at a temperature from about 225° C. to about 340° C.; and (g) redirecting the virgin distillate feedstock to the now higher temperature zone which now contains the less active catalyst and which is now operated at a temperature from about 325° C. to about 425° C., but at a temperature at least 25° C. in excess of that of the now lower temperature reaction zone; and (h) repeating the above steps when the color of either product stream, or the combined product stream exceeds a predetermined color range for an indefinite number of cycles.

2. The process of claim 1 wherein both the virgin feedstock and the cracked feedstock boil in the range of about 140° C. to about 360° C.

3. The process of claim 2 wherein the cracked feedstock is a light cycle oil from a fluid catalytic cracking process unit.

4. The process of claim 2 wherein the catalyst in each of the reaction zones is comprised of about 2 to 20 wt. % Group VIII metal and about 5 to 50 wt. % Group VI metal on an alumina support.

5. The process of claim 4 wherein the amount of Group VIII metal is from about 4 to 12 wt. % and the mount of Group VI metal is from about 20 to 30 wt. %.

* * * * *